US010960694B2

(12) United States Patent
Zaizen

(10) Patent No.: US 10,960,694 B2
(45) Date of Patent: Mar. 30, 2021

(54) PRINTING APPARATUS AND PROCESSING APPARATUS

(71) Applicant: CANON KABUSHIKI KAISHA, Tokyo (JP)

(72) Inventor: Naoki Zaizen, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/723,509

(22) Filed: Oct. 3, 2017

(65) Prior Publication Data

US 2018/0037041 A1 Feb. 8, 2018

Related U.S. Application Data

(63) Continuation of application No. PCT/JP2016/004388, filed on Sep. 28, 2016.

(30) Foreign Application Priority Data

Sep. 29, 2015 (JP) ..... JP2015-192044
Dec. 25, 2015 (JP) ..... JP2015-254382

(51) Int. Cl.
*B41J 29/12* (2006.01)
*B41J 29/13* (2006.01)
*B41J 2/01* (2006.01)

(52) U.S. Cl.
CPC ..... *B41J 29/13* (2013.01); *B41J 2/01* (2013.01); *B41J 29/12* (2013.01)

(58) Field of Classification Search
None
See application file for complete search history.

(56) References Cited

U.S. PATENT DOCUMENTS 5,044,801 A * 9/1991 Uchimura ..... B41J 29/02 400/692
8,235,613 B2 * 8/2012 Hosono ..... B41J 11/70 400/621
8,272,798 B2 * 9/2012 Yoshioka ..... B41J 15/042 347/22
8,482,587 B2 7/2013 Sakaino
(Continued)

FOREIGN PATENT DOCUMENTS

JP 05-309913 A 11/1993
JP 2001-033928 A 2/2001
(Continued)

OTHER PUBLICATIONS

International Search Report dated Dec. 20, 2016, in International Application No. PCT/JP2016/004388.
(Continued)

*Primary Examiner* — Alejandro Valencia
(74) *Attorney, Agent, or Firm* — Venable LLP

(57) ABSTRACT

A user's fingertip is prevented from entering a housing while a cover is closed. A printing apparatus includes: a housing containing a printing unit therein; a cover openably attached to the housing, the cover forming a discharging opening, through which a sheet is discharged from the housing, while the cover is closed; and a protective wall portion provided inside the cover for preventing a user's fingertip inserted through the discharging opening from proceeding toward the printing unit while the cover is closed.

23 Claims, 14 Drawing Sheets

(56) References Cited

U.S. PATENT DOCUMENTS

| | | | | |
|---|---|---|---|---|
| 2009/0035045 | A1 | 2/2009 | Yoshioka | |
| 2013/0188209 | A1 | 7/2013 | Horikawa et al. | |
| 2015/0138299 | A1* | 5/2015 | Matsuya ..... | B26D 7/22<br>347/218 |

FOREIGN PATENT DOCUMENTS

| | | | |
|---|---|---|---|
| JP | 2006-044128 | A | 2/2006 |
| JP | 2006-142608 | A | 6/2006 |
| JP | 2006-326880 | A | 12/2006 |
| JP | 2013-150247 | A | 8/2013 |
| JP | 2015-044395 | A | 3/2015 |
| WO | 2010066160 | A1 | 6/2010 |

OTHER PUBLICATIONS

Extended European Search Report issued in corresponding European Application No. EP16850675, dated May 6, 2019.

* cited by examiner

PRINTING APPARATUS AND PROCESSING APPARATUS

CROSS-REFERENCE TO RELATED APPLICATIONS

This application is a Continuation of International Patent Application No. PCT/JP2016/004388, filed Sep. 28, 2016, which claims the benefit of Japanese Patent Application No. 2015-192044, filed Sep. 29, 2015, and Japanese Patent Application No. 2015-254382, filed Dec. 25, 2015, all of which are hereby incorporated by reference herein in their entirety.

BACKGROUND OF THE INVENTION

Field of the Invention

The present invention relates to an apparatus such as a printing apparatus having a housing and an access cover.

Background Art

Some printing apparatuses have an interlock function for preventing printing operation upon the opening of an apparatus cover. Patent Literature 1 discloses an inkjet printer having an interlocking mechanism.

CITATION LIST

Patent Literature

PTL 1: Japanese Patent Laid-Open No. 2006-142608

SUMMARY OF THE INVENTION

In some printing apparatuses, a carriage and the like in an apparatus are slightly seen from a discharging opening while an apparatus cover is closed. It is necessary to prevent a user from inserting the user's finger into the apparatus through the discharging opening during the operation of the apparatus.

A problem to be solved by the present invention is to provide an apparatus capable of more effectively preventing a user's finger from entering a housing while a cover is closed.

In one aspect of the present invention for solving the above problem, a printing apparatus is characterized by comprising: a housing containing a printing unit therein; a cover openably attached to the housing, the cover forming a discharging opening, through which a sheet is discharged from the housing, while the cover is closed; and a protective wall portion provided inside the cover for preventing a user's fingertip inserted through the discharging opening from proceeding toward the printing unit while the cover is closed.

Further features of the present invention will become apparent from the following description of exemplary embodiments with reference to the attached drawings.

DESCRIPTION OF THE EMBODIMENTS

Embodiments of the present invention will be described below in detail with reference to the drawings.

First Embodiment

Figure 1:
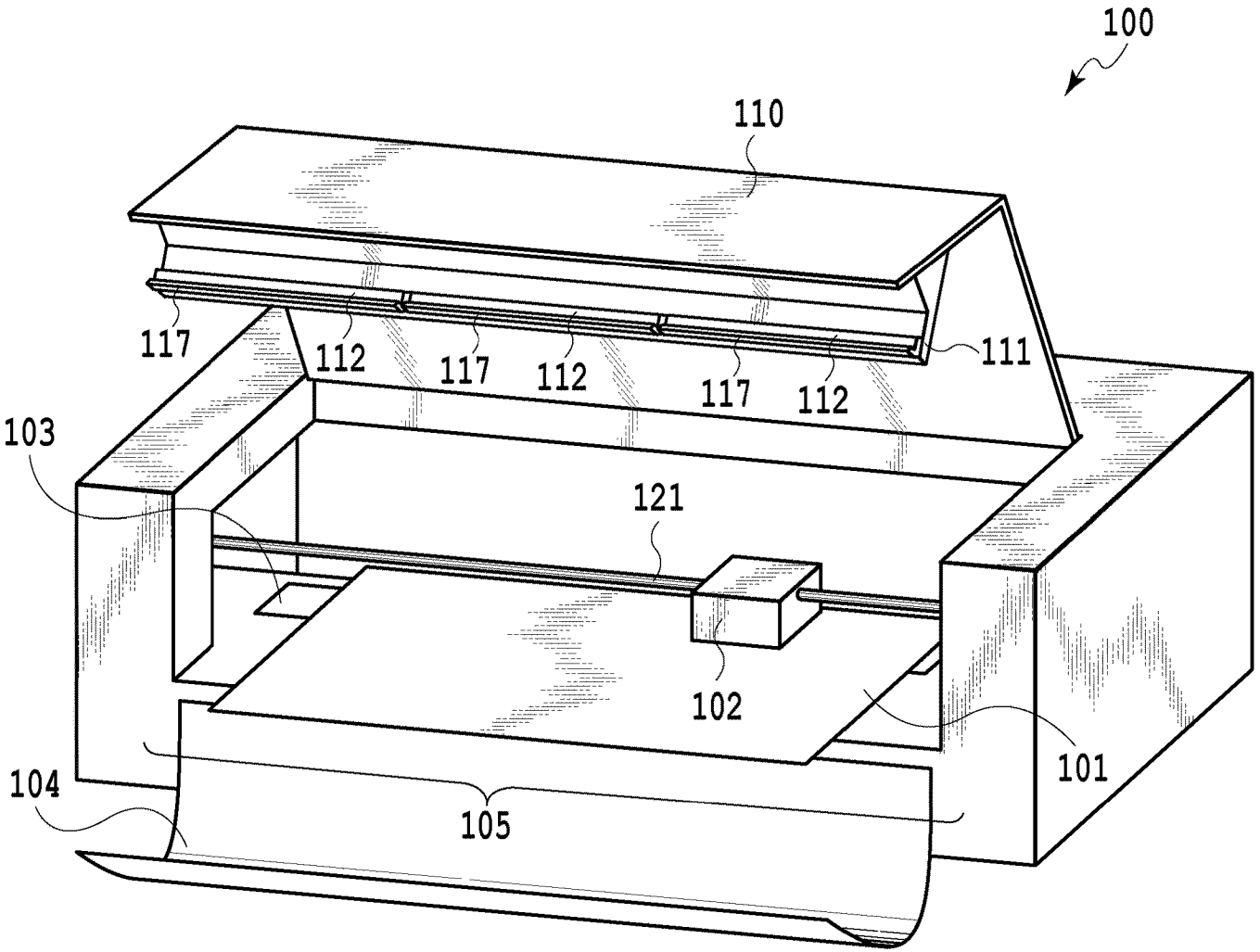
FIG. 1 is a perspective view of an inkjet printing apparatus according to a first embodiment of the present invention.
Figure 2:
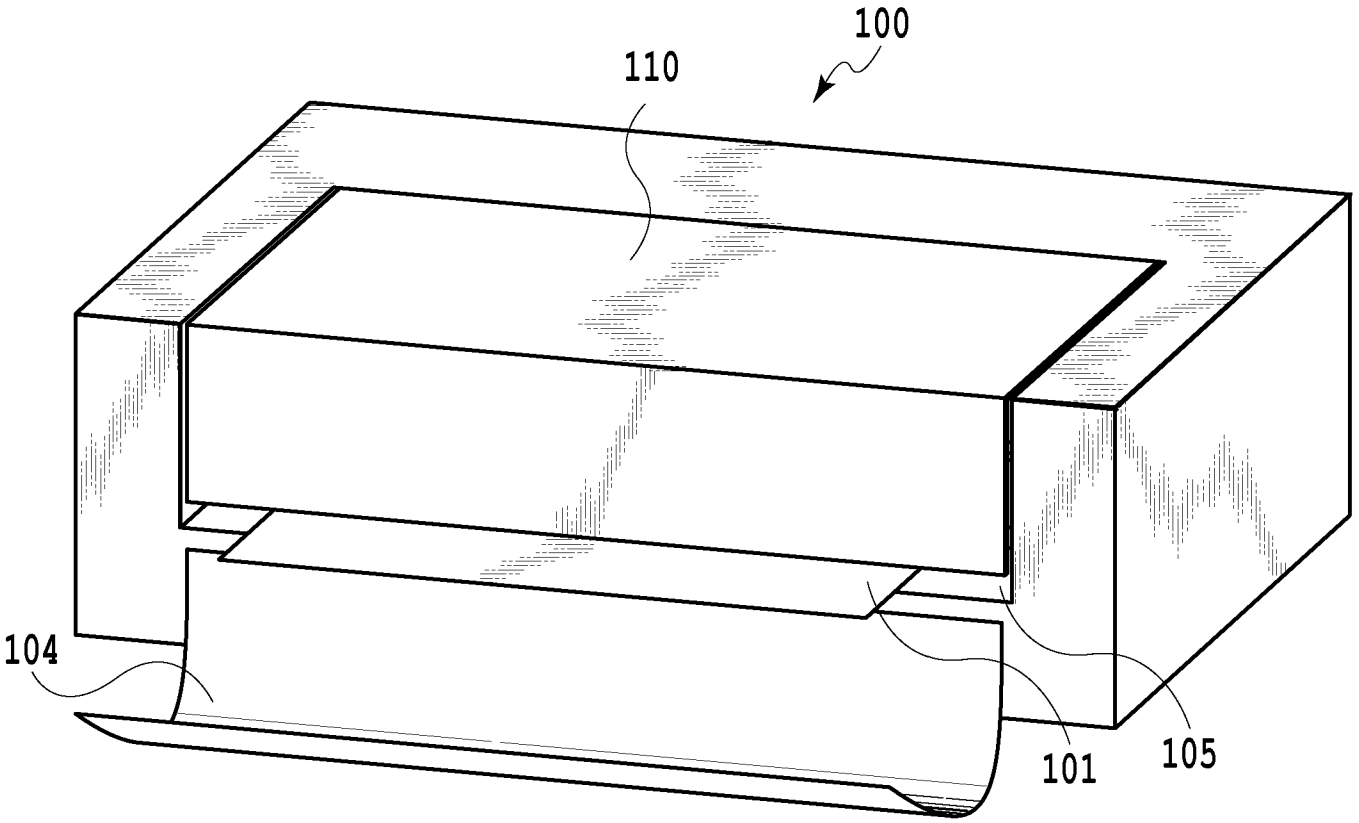
FIG. 2 is a perspective view of the printing apparatus with a cover closed.

FIG. 1 and FIG. 2 are schematic perspective views of an inkjet printing apparatus according to a first embodiment of the present invention. FIG. 1 shows the apparatus with a cover opened and FIG. 2 shows the apparatus with the cover closed.

A printing apparatus 100 has a printing unit 102. The main part of the printing unit 102 is a carriage movable along a guide shaft 121 and a printing head mounted on the carriage. The printing head ejects ink of several colors under an inkjet system. The carriage is equipped with ink tanks each storing ink to be supplied to the printing head. Alternatively, ink may be supplied to the carriage through ink tubes without mounting the ink tanks on the carriage. Further, the printing unit may use a system other than the inkjet system.

The carriage can reciprocate along the guide shaft 121 and scan a sheet 101 using the printing head. The sheet 101 is wound in a roll (not shown) and is fed from the roll at the time of printing. The sheet 101 is conveyed over a platen 103 by a conveying roller and discharged. During the conveyance, the printing unit 102 scans an area of the sheet 101 corresponding to the platen 103, thereby performing printing on the area under a serial printing system. The printed sheet 101 is discharged from a discharging opening 105, which is an opening formed between a housing and an access cover 110. A cutter is provided on the periphery of the front of the discharging opening 105. After the rear end of the printed area of the sheet is cut, the sheet is discharged from the discharging opening 105 and dropped and stored in a basket 104 made of cloth.

The access cover 110 is openably attached to the housing that inclusively covers the entire printing mechanism including the printing unit 102 described above. The access cover 110 can be opened and closed by turning the access cover 110 about a turning shaft provided in the body of the apparatus.

While the access cover 110 is closed, the access cover 110 covers the opened part of the housing, namely, the top and front of the apparatus. Printing operation is performed while the access cover 110 is closed as shown in FIG. 2. At the time of maintenance of the printing unit such as ink tank or head replacement, a user opens the access cover 110 to perform the maintenance. That is, the access cover 110 is provided such that a user can perform maintenance such as ink tank replacement or removal of a jammed sheet in the printing unit 102 while the access cover 110 is opened (FIG. 1).

In the case of a minor jam in printing operation with the access cover 110 closed (FIG. 2), a user can perform recovery by inserting the user's hand through the discharging opening 105 and pulling the sheet out while the access cover 110 remains closed. In the case of a major jam that cannot be cleared in the above manner, the user opens the access cover 110 to perform recovery.

The access cover 110 is equipped with a protective wall portion 111, which is located near the sheet discharging opening 105 while the access cover 110 is closed. The protective wall portion 111 has sliding shutters 112 (sliding members in the form of plates). In the present embodiment, the sliding shutters 112 are provided to correspond to three areas obtained by dividing the entire area in the width direction of a sheet to be discharged. However, the number of divisions is not limited to three but may be determined according to the width of the printing apparatus such that each divided sliding shutter 112 can smoothly slide. In the case of a small printing apparatus, the sliding shutter 112 may be a single member without being divided.

The sliding shutters 112 face the discharging opening while the access cover is closed and are configured to slide independently of each other. As a result, the sliding shutters 112 can prevent a user from inserting the user's fingertip into the apparatus and touching the moving carriage and the like during the operation of the apparatus, as will be described later in detail with reference to FIG. 3 onward.

While the access cover 110 is closed, an engaging portion (not shown) of the printing apparatus 100 is engaged with a corresponding engaging portion (not shown) of the access cover 110. The engagement locks the access cover 110 and keeps it closed.

The body of the printing apparatus 100 is equipped with a sensor for detecting the opening and closing of the access cover 110 to perform interlocking. The sensor may be a mechanical sensor such as a limit switch or an optical sensor. The sensor detects that the access cover 110 is opened. More specifically, sensor detection is turned on in a case where the completely-closed access cover 110 moves to a height of about 1 cm. Interlocking is performed using the sensor. A control unit of the printing apparatus performs control so as to prevent printing operation while the sensor detects that the access cover 110 is opened and performs control so as to immediately stop printing operation in a case where the sensor detects that the access cover 110 is opened in the printing operation.

Figure 3:
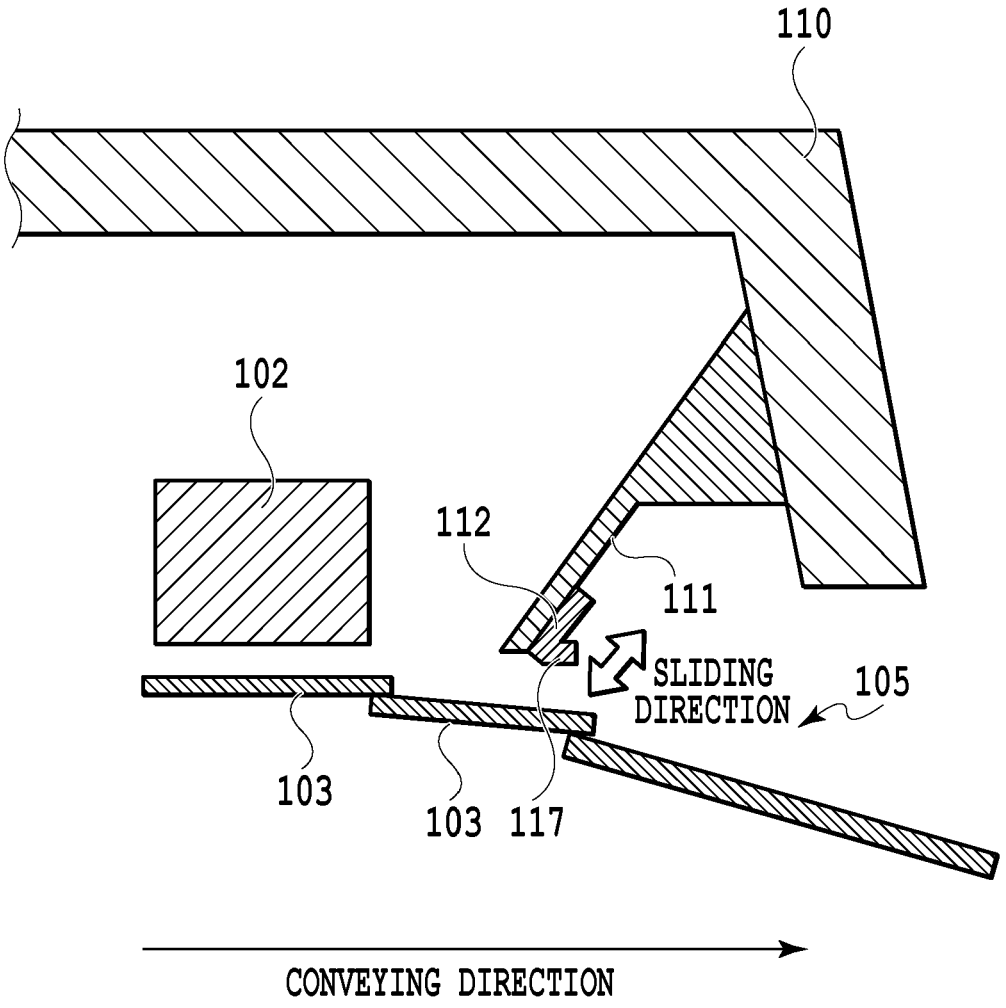
FIG. 3 is a schematic cross-sectional view showing a relationship between a protective wall portion in an access cover and an area to be printed by a printing unit.

FIG. 3 is an illustration of a relationship between the protective wall portion 111 in the access cover and an area to be printed by the printing unit 102.

The protective wall portion 111 is provided on the inner face of the access cover 110, thereby preventing a user's finger from proceeding toward the printing unit 102 inside the housing. While the access cover 110 is closed, the protective wall portion 111 is located downstream of the printing unit 102 in a discharging direction of the sheet 101 and the lower end of the protective wall portion 111 is located at a level of 20 mm or less above the platen 103 below the lower end in the height direction. In a main scanning direction (sheet width direction), the protective wall portion 111 is provided over almost the entire area of the discharging opening 105. A slanting direction of the protective wall portion 111 corresponds to a schematic slanting surface that slants downward and upstream in the discharging direction.

As described above with reference to FIG. 1, the protective wall portion 111 is equipped with the sliding shutters 112, which are slidably provided in the three areas obtained by dividing almost the entire area in the width direction. The lower ends of the sliding shutters 112 and the platen 103 define the upper and lower ends of the discharging opening. The ends (lower ends in the direction of gravity) of the sliding shutters 112 are equipped with finger blocking portions 117 (fingertip contacting portions). Each finger blocking portion 117 has a shape bent to an acute angle toward the side on which a sheet is discharged, as viewed in cross section. Accordingly, in a case where a user's finger enters in this position as will be described later with reference to FIG. 6 and the like, the finger is caught and blocked by the finger blocking portion 117 of the sliding shutter 112, thereby effectively preventing the finger from proceeding further.

Figure 4:
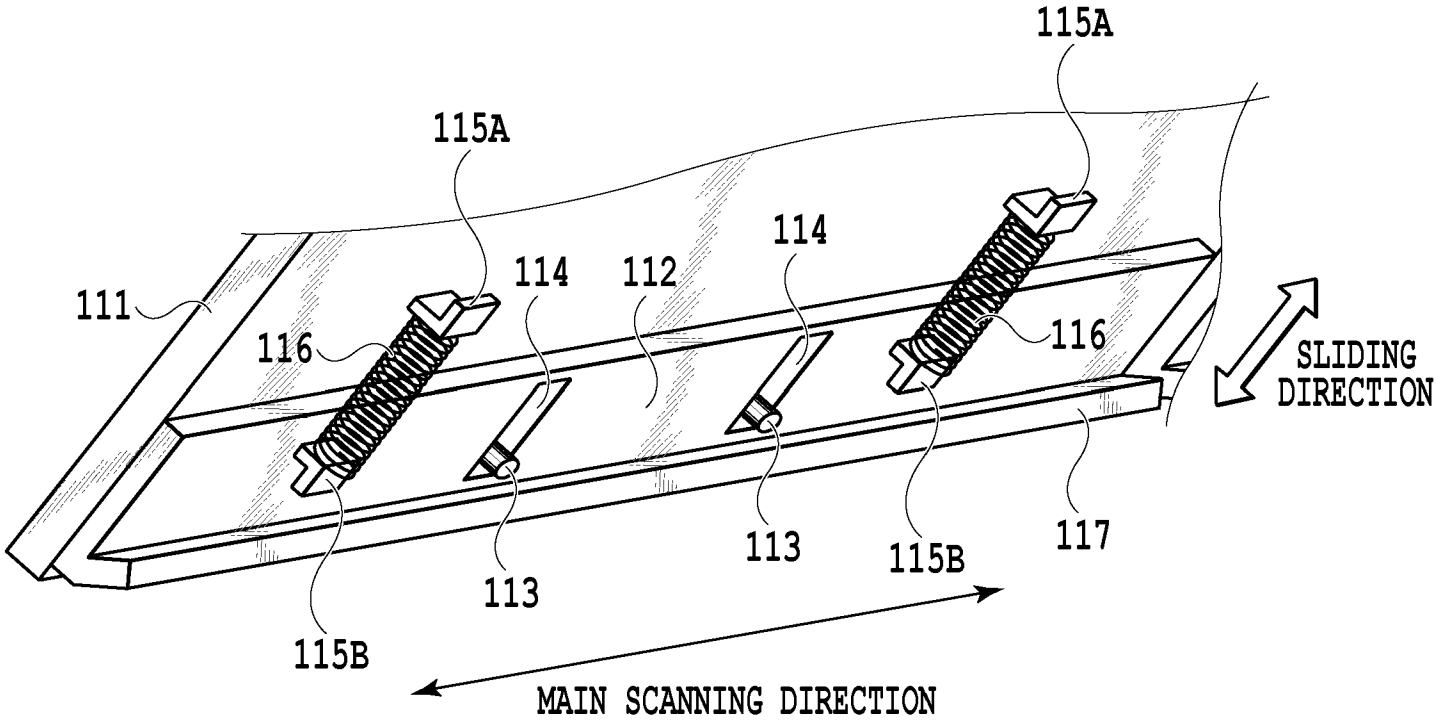
FIG. 4 is a perspective view showing a detailed configuration of a sliding shutter in the protective wall portion.

FIG. 4 is a perspective view showing a detailed configuration of one of the sliding shutters 112 in the protective wall portion 111.

The protective wall portion 111 is equipped with projections 113 in the positions corresponding to two slits 114 provided in the sliding shutter 112. Since the projections 113 restrict the movement of the slits 114, the sliding shutter 112 slides in a slanting sliding direction (slanting backward direction) shown in the drawing. The projections 113 also restrict the movable range of the sliding shutter 112 in cooperation with the slits 114. Each of the protective wall portion 111 and the sliding shutter 112 is equipped with two hooks 115A or 115B. A spring 116 is held between each pair of hooks 115A and 115B, which biases the sliding shutter 112 toward the hook 115A of the protective wall portion 111. As a result, the slits 114 of the sliding shutter 112 are pushed against the projections 113 in the protective wall portion 111 at the end of the slidable range of the sliding shutter 112 closest to the hook 115A, and the sliding shutter 112 is maintained in the predetermined position against the biasing force. This prevents the sliding shutter 112 from sliding downward by gravity and remaining at the end of the slidable range closest to the hook 115B. Consequently, it is possible to prevent the area of the discharging opening from decreasing in printing operation and the sliding shutter from causing a sheet jam and the like.

In the above embodiment, the springs 116 are used to bias the sliding shutter 112 upward and maintain it in the state of preventing a decrease in the area of the discharging opening.

However, any form may be applied to maintain the position of the sliding shutter 112 with respect to the protective wall portion 111 as long as it can prevent the sliding shutter 112 from decreasing the area of the discharging opening.

Figure 5:
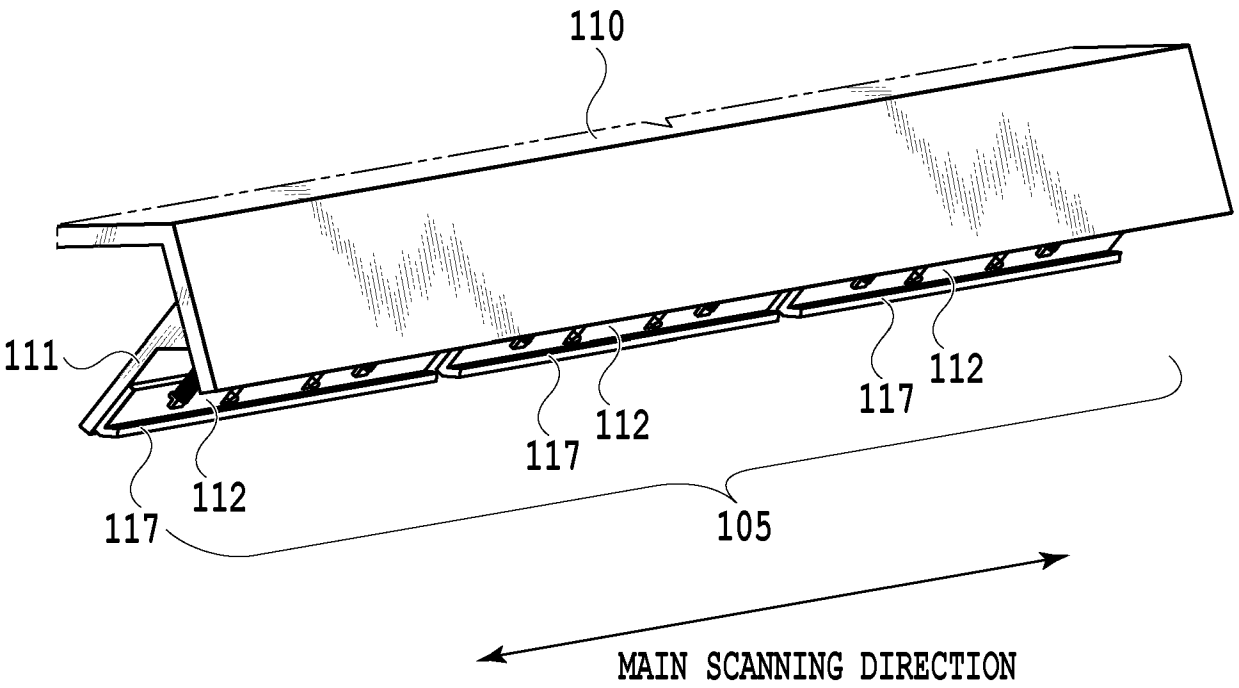
FIG. 5 is a perspective view showing a positional relationship between the protective wall portion and the sliding shutters in the access cover.

FIG. 5 is a perspective view showing a positional relationship between the protective wall portion 111 and the sliding shutters 112 in the access cover 110 and shows the details of the sliding shutters 112 shown in FIG. 1. Three sliding shutters 112 each having the configuration shown in FIG. 4 are provided in the protective wall portion 111 in the main scanning direction of the discharging opening 105, thereby covering the entire area of the discharging opening 105. The protective wall portion 111 and the sliding shutters 112 are provided in the main scanning direction as stated above in the present embodiment, but a single sliding shutter 112 may be provided over the entire area of the discharging opening.

Figure 6:
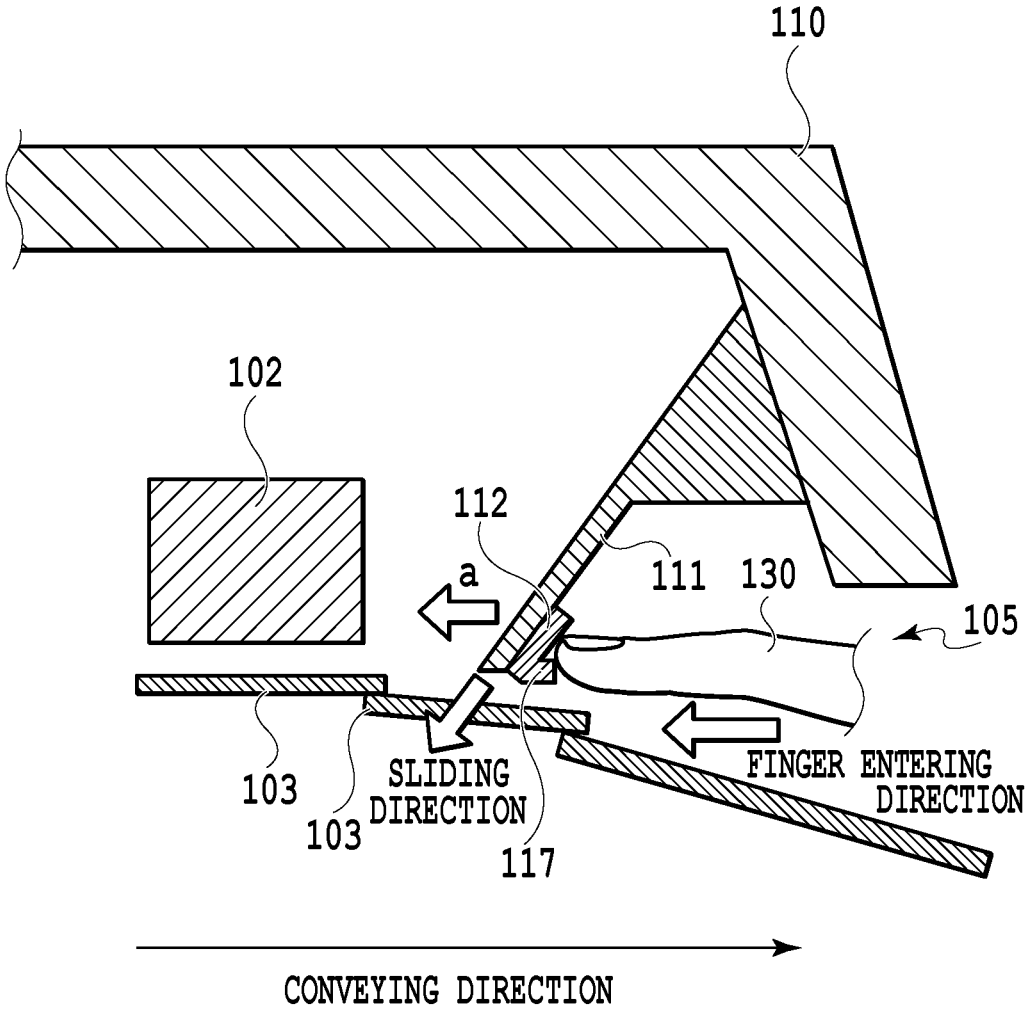
FIG. 6 is a schematic cross-sectional view showing the movement of the sliding shutter in a case where a user's fingertip touches the sliding shutter in the apparatus.

FIG. 6 is a schematic cross-sectional view showing the movement of the sliding shutter in a case where a user inserts the user's finger through the discharging opening 105 (opening) without opening the access cover and touches the sliding shutter with the user's fingertip.

Figure 7:
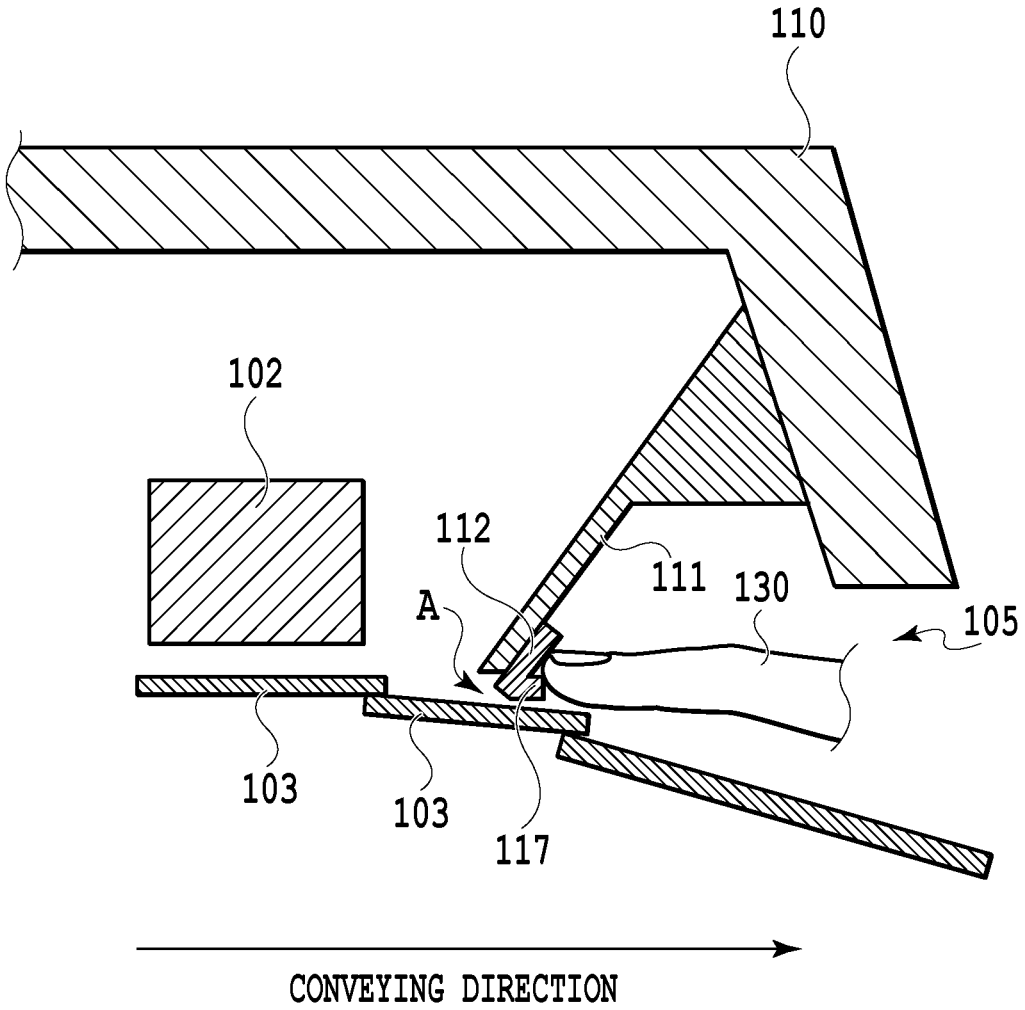
FIG. 7 is a schematic cross-sectional view showing a state where a user's fingertip touches the sliding shutter in the apparatus and a gap between the protective wall portion and a platen is narrowed.

A fingertip 130 entered through the discharging opening 105 is in contact with the finger blocking portion 117 at the end of the sliding shutter 112 and is blocked by the finger blocking portion 117. The fingertip 130 pushes the finger blocking portion 117 to proceed further, with the result that a force a acts on the sliding shutter 112 in the same direction as a proceeding direction of the fingertip 130. The sliding shutter 112 slides in a slanting sliding direction, that is, a slanting backward direction slanting with respect to a pushing direction of the fingertip 130 (the horizontal direction in this example). After the sliding shutter 112 moves to the end in the slanting backward direction, a gap A between the protective wall portion 111 and the platen 103 is narrowed as shown in FIG. 7. The sliding shutter 112 does not slide further even by being pushed by the fingertip 130 and the finger cannot proceed further. The action of the sliding shutter 112 that slides in the above manner prevents the fingertip 130 from entering inside the protective wall portion 111.

In the present embodiment, the numerical value of the narrowest gap A (FIG. 7) ranges from 3 mm to 10 mm in the direction of gravity, and preferably ranges from 3 mm to 5.5 mm. This size of the gap A can prevent even a child's fingertip from entering the gap A. Accordingly, the closed sliding shutter 112 can block any user from, for example, touching the moving carriage during printing operation.

In the present embodiment, the finger blocking portions 117 (fingertip contacting portions) are provided on the lower end of the protective wall portion (sliding shutters). This allows a user's fingertip to touch the finger blocking portion 117 so as to reliably slide the sliding shutter and effectively prevent the fingertip from entering deep inside the apparatus. The shape of the finger blocking portion 117 is not limited to the bent shape as long as a user's fingertip 130 is easily caught and blocked by the finger blocking portion 117. For example, the finger blocking portion 117 may have a shape protruding toward the side from which a fingertip enters.

Second Embodiment

Figure 8:
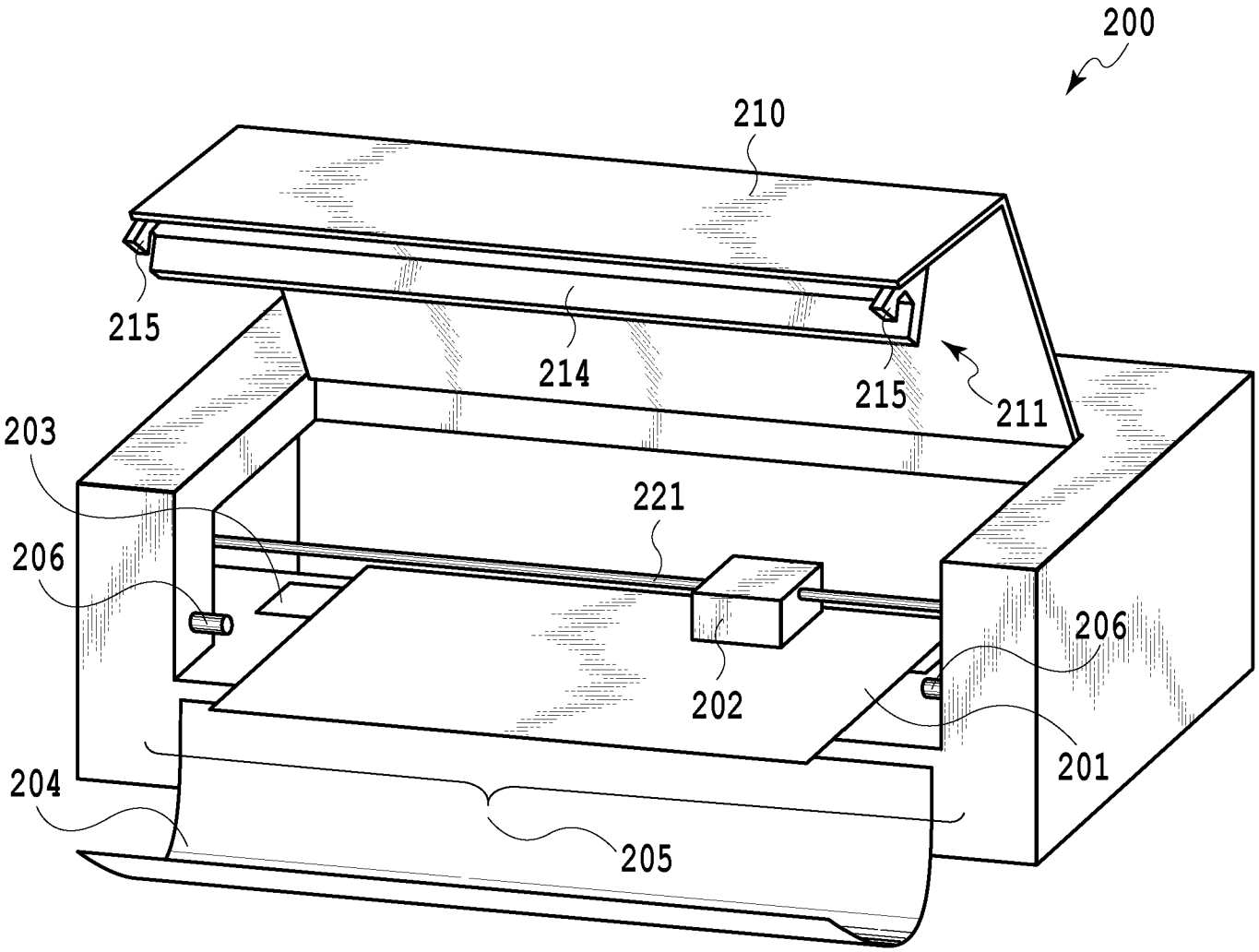
FIG. 8 is a perspective view of an inkjet printing apparatus according to a second embodiment of the present invention.

Next, a second embodiment of the present invention will be described. FIG. 8 shows a printing apparatus 200 with an access cover 210 opened. In the use of the apparatus, the access cover 210 is closed and brought into a state similar to the state previously shown in FIG. 2. In the printing apparatus 200 according to the present embodiment, configurations for causing a printing unit 202 to perform a scan and conveying a sheet 201 are the same as those in the printing apparatus 100 according to the first embodiment described above and accordingly their description will be omitted. A description will be provided below mainly for a different configuration from that of the printing apparatus according to the first embodiment.

The access cover 210 is equipped with a cover side member 211, which is located near a discharging opening 205 while the access cover 210 is closed. The cover side member 211 includes a protective wall portion (protective wall portion) 214 and engaging portions 215. The protective wall portion 214 is disposed over the entire area in the width direction of a sheet to be discharged and faces the discharging opening while the access cover is closed. The protective wall portion 214 is provided to prevent a user from inserting the user's fingertip into the apparatus and touching a moving carriage and the like during the operation of the apparatus.

Each of both ends of the protective wall portion 214 is equipped with the engaging portion 215 (stopper). The engaging portions 215 are engaged with projections (body side members) 206 provided in the body (housing) of the printing apparatus. The material and the thickness of the protective wall portion 214 are determined so as to enable elastic deformation.

The projection 206 on the apparatus body side is provided on each of both ends of the discharging opening 205, as shown in FIG. 8. While the access cover 210 is closed, the projections 206 of the printing apparatus 200 are engaged with the engaging portions 215 of the access cover 210. The engagement locks the access cover 210 and keeps it closed. As will be described with reference to FIG. 9 onward, the cover side member 211 of the access cover 210 keeps the access cover 210 closed in cooperation with the projections 206 on the apparatus body side even though a user's finger and the like touch the protective wall portion 214. Like the first embodiment, the body of the printing apparatus 200 has a sensor for detecting the opening and closing of the access cover 210 to perform interlocking.

Figure 9:
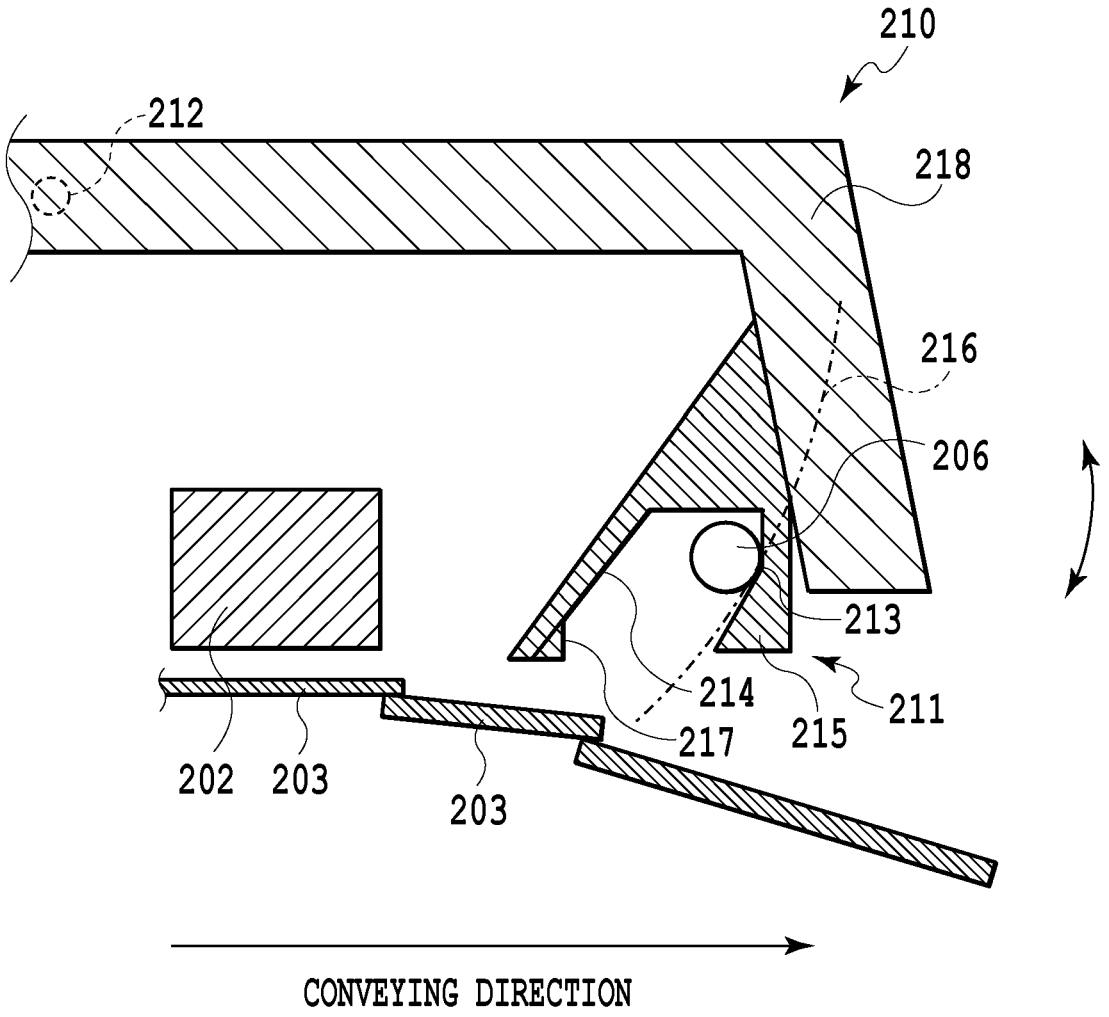
FIG. 9 is a schematic cross-sectional view showing the engagement between a cover side member and projections in an access cover according to the second embodiment.

FIG. 9 is a schematic cross-sectional view showing the engagement between the engaging portions 215 in the access cover 210 and the projections 206 shown in FIG. 8 in particular. As described above, the access cover 210 is turnably supported by the printing apparatus 200. In FIG. 9, the turning shaft 212 of the access cover 210 is located upstream of the printing unit 202 in the sheet discharging direction and above the printing unit 202. This location of the turning shaft 212 makes it possible to secure a wide opening area while the access cover 210 is opened as well as to reduce the height of the apparatus body, that is, miniaturize the printing apparatus 200. Since the wide opening area can be secured, the workability of maintenance and the like by a user, a serviceman and the like can be improved. In the body of the printing apparatus 200, the projection 206 provided on each of both ends of the discharging opening 205 is located downstream of the printing unit 202 in the discharging direction and at about the same height as that of the printing unit 202 in FIG. 9. While the access cover 210 is closed, contacting portions 213 of the engaging portions 215 in the access cover 210 are in contact with the projections 206, thereby keeping the access cover 210 closed.

As described above, the protective wall portion 214 is provided inside the access cover 210 over the entire width of the access cover, that is, the entire area of the discharging opening 205 in the scanning direction of the printing head. The protective wall portion 214 is located downstream of the printing unit 202 and upstream of the contacting portions 213 between the cover side member 211 of the access cover 210 and the projections 206 in the discharging direction. In the height direction, the lower end of the protective wall portion 214 is located above the platen 203. The dimensions of a gap between the lower end of the protective wall portion 214 and the platen 203 are determined such that a user's fingertip cannot enter the gap. The protective wall portion 214 slants upward and upstream in the sheet discharging direction. A discharging opening 205 is formed between the lower end of the protective wall portion 214 of the access cover 210 and the platen 203.

The engaging portions 215 of the access cover 210 protrude from the lower part of a bent portion 218 of the access cover 210 toward the inside of the cover in FIG. 9 and are formed integrally with the protective wall portion 214 similarly protruding toward the inside. The engaging portions 215 and the protective wall portion 214 form U-shaped portions that enclose the projections 206 while being engaged with the projections. The U-shape formed by the engaging portion 215 partly includes a circumcircle 216 that has its center at the turning shaft 212 of the access cover 210 and passes through the contacting portion 213 of the engaging portion with the projection 206.

The end (lower end in the direction of gravity) of the protective wall portion 214 is equipped with a finger blocking portion 217 (fingertip contacting portion, not shown in FIG. 10 onward) that engages and blocks a user's fingertip. The lower end of the protective wall portion 214 protrudes toward the outside of the apparatus from which a user's fingertip enters such that the finger blocking portion 217 has a substantially triangular shape and the fingertip is in contact with and caught by one side of the triangle. The finger blocking portion 217 may have a bent shape like the first embodiment. The protective wall portion 214 may be equipped with the sliding shutters 112 described in the first embodiment.

Figure 10:
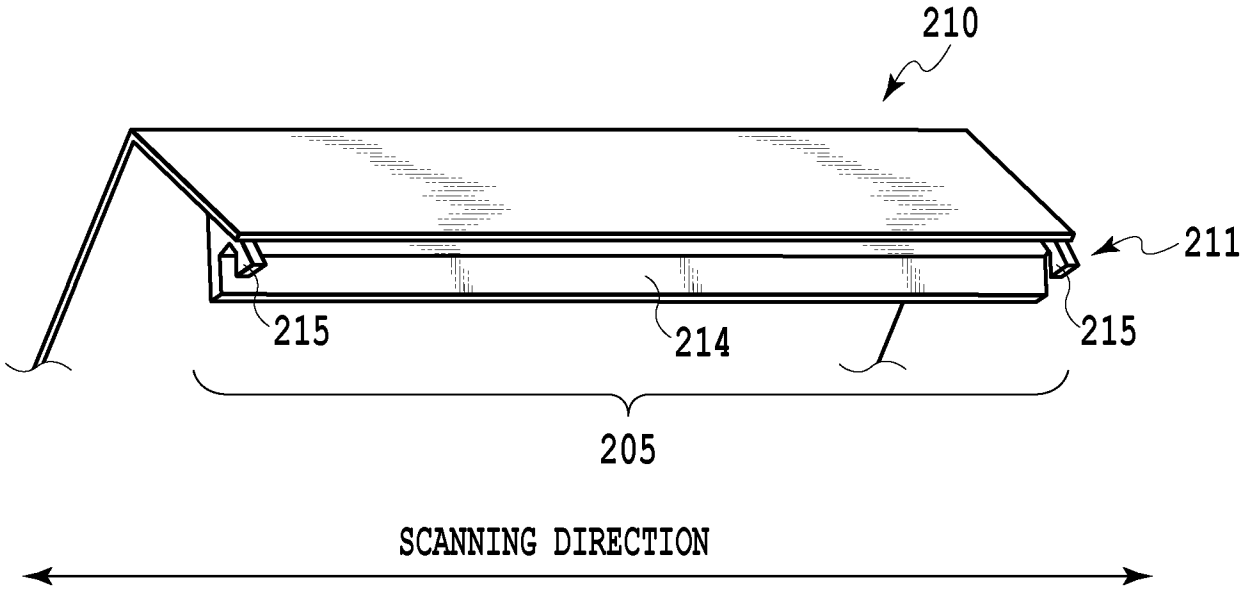
FIG. 10 is a perspective view showing a positional relationship between a protective wall portion and engaging portions in the access cover.

FIG. 10 is a perspective view showing a positional relationship between the protective wall portion 214 and the engaging portions 215 in the cover side member 211. As described above, the protective wall portion 214 is provided over the entire area of the discharging opening 205 in the scanning direction and the engaging portion 215 is provided on each of both ends of the discharging opening 205. The protective wall portion 214 and the engaging portions 215 are made of the same member in the present embodiment, but they are not limited to this. For example, the protective wall portion 214 and the engaging portions 215 may be different members connected to each other. Any member may be used provided that it functions as will be described later with reference to FIG. 12A, FIG. 12B and the like.

Figure 11:
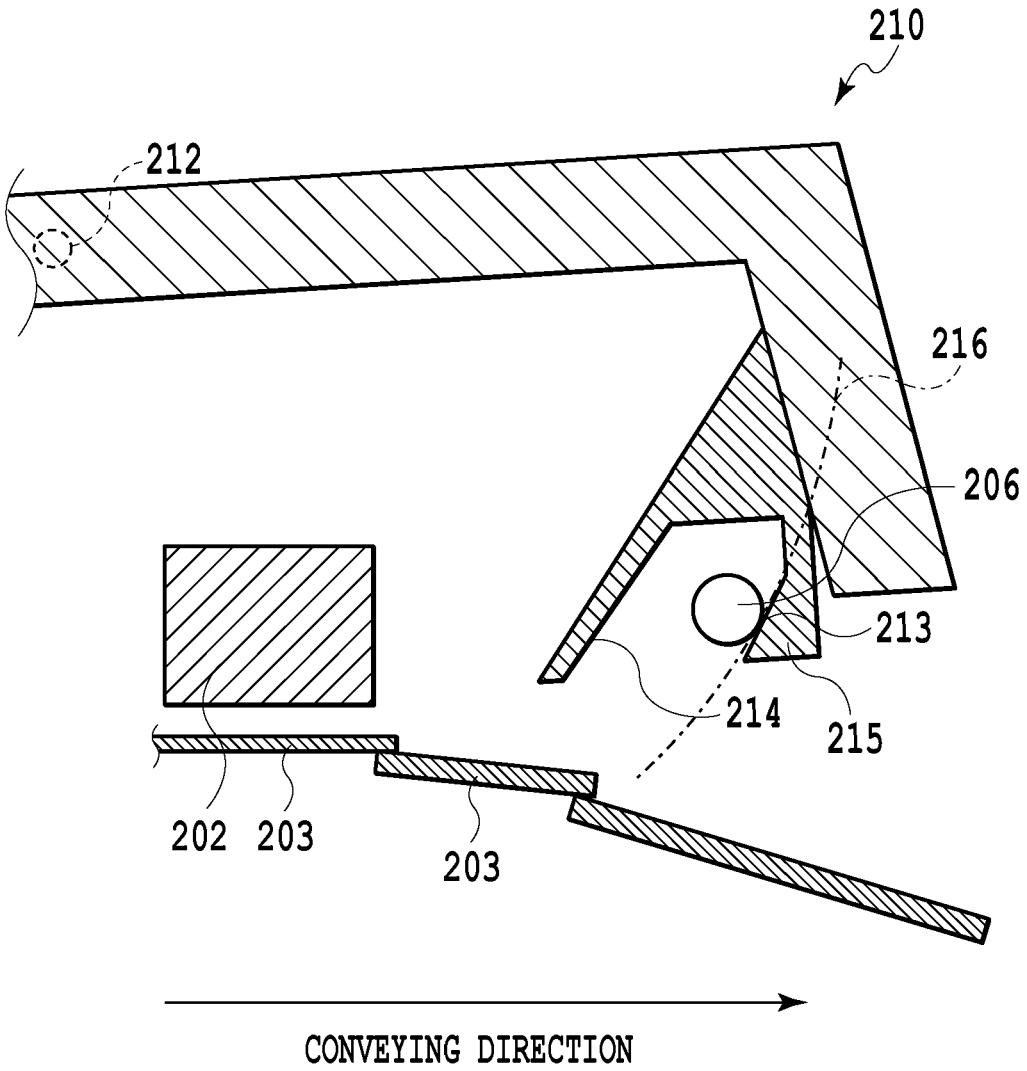
FIG. 11 is an illustration of the engagement between the projections and the engaging portions at the time of opening and closing the access cover.

FIG. 11 is an illustration of the engagement between the projections 206 and the engaging portions 215 at the time of opening and closing the access cover 210. At the time of opening and closing the access cover 210, the engaging portions 215 have a shape partly including the circumcircle 216 that has its center at the turning shaft 212 and passes through the contacting portions 213 with the projections 206 as described above. A force that inhibits the access cover 210 from being opened and closed is usually not applied to the engaging portions 215 by the projections 206 at the time of opening and closing the access cover 210.

However, in a case where a user inserts the user's fingertip into the apparatus through the opening of the discharging opening 205 to touch the protective wall portion 214 while the access cover 210 is closed, a force that inhibits the access cover 210 from being opened is generated. The mechanism will be described below.

Figure 12A:
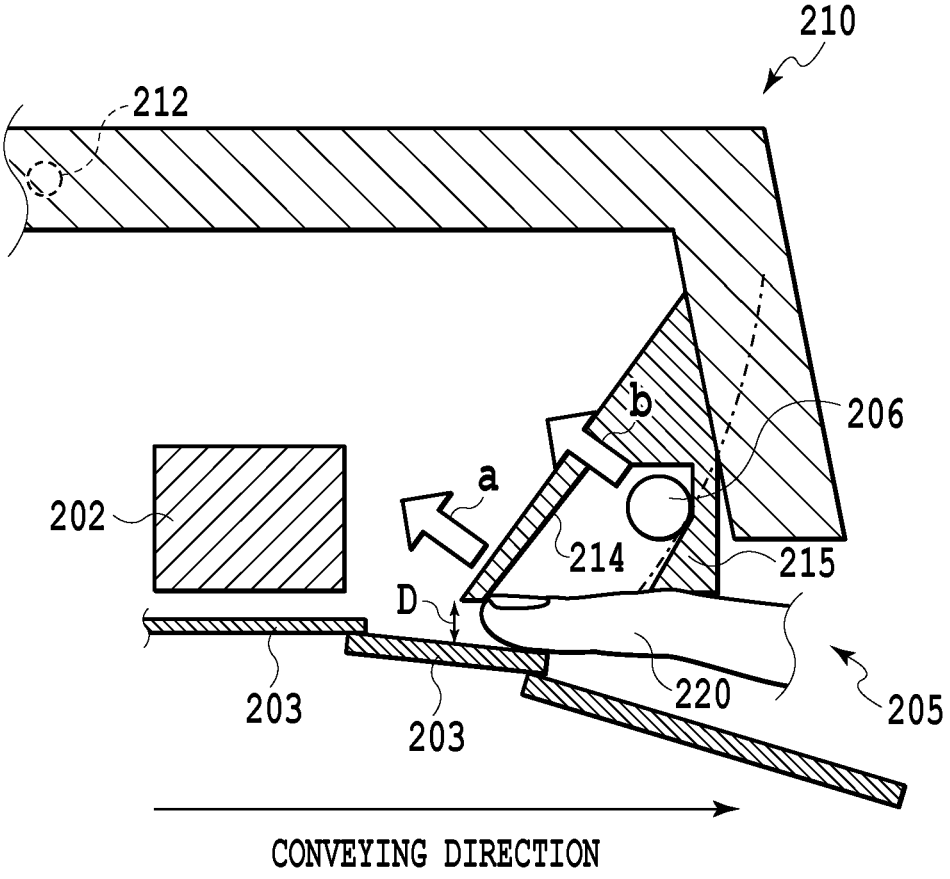
FIG. 12A is an illustration of forces that act on the access cover in a case where a user's fingertip touches the protective wall portion in the apparatus.
Figure 12B:
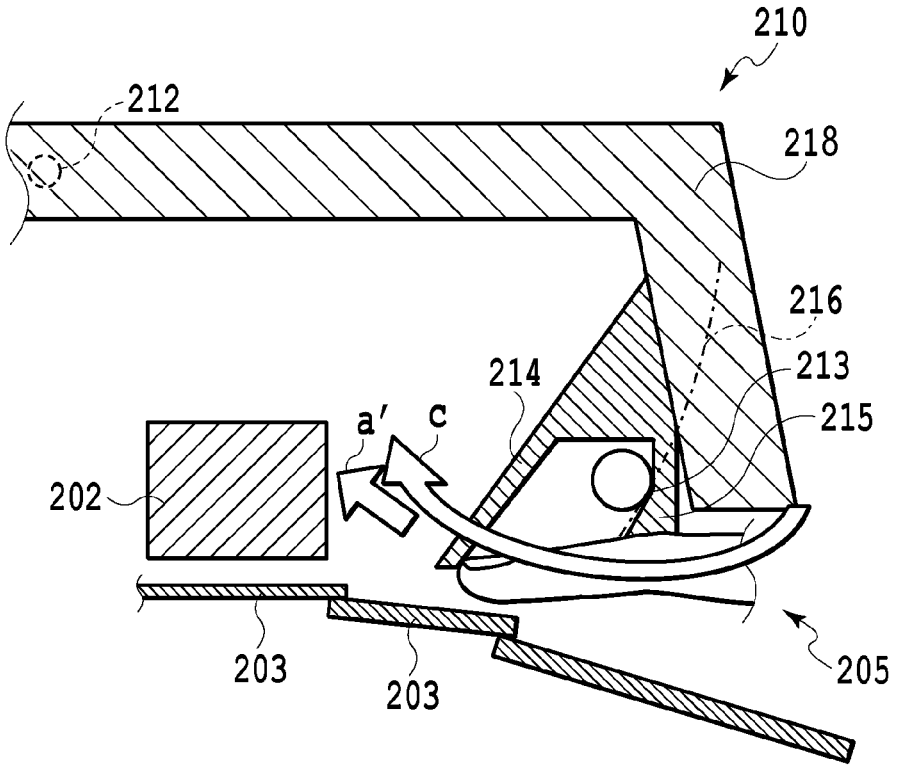
FIG. 12B is another illustration of forces that act on the access cover in a case where a user's fingertip touches the protective wall portion in the apparatus.

FIG. 12A and FIG. 12B are illustrations of forces that act on the access cover 210 in a case where a user's fingertip enters the apparatus through the discharging opening 205 and pushes the protective wall portion 214. As shown in FIG. 12A, a user's fingertip 220 touches the protective wall portion 214 after entering the apparatus through the discharging opening 205. In FIG. 12A, a distance D between the lower end of the protective wall portion 214 and the platen 203 has a value ranging from 3 mm to 10 mm in the present embodiment, and preferably a value determined within a range from 3 mm to 5.5 mm. This distance can prevent even a child's fingertip from entering the gap. Accordingly, the protective wall portion 214 can inhibit any user's fingertip 220 from touching the moving carriage during printing operation.

The finger touches the protective wall portion 214, thereby exerting a force a on the protective wall portion 214 in its normal direction. Since the protective wall portion 214 and the engaging portions 215 are integral components, a force b also acts on the engaging portions 215 of the access cover 210 in the same direction. The force b pushes the engaging portions 215 against the projections 206.

As the fingertip 220 further proceeds, a force a' elastically deforms the protective wall portion 214 as shown in FIG. 12B. The elastic deformation causes the access cover to become warped in a direction c in such a manner that it turns about the proximity of the bent portion 218 of the access cover 210. As a result, the engaging portions 215 are elastically deformed to positions upstream in the discharging direction from the circumcircle 216 that has its center at the turning shaft 212 of the access cover 210 and passes through the contacting portion 213.

Figure 13:
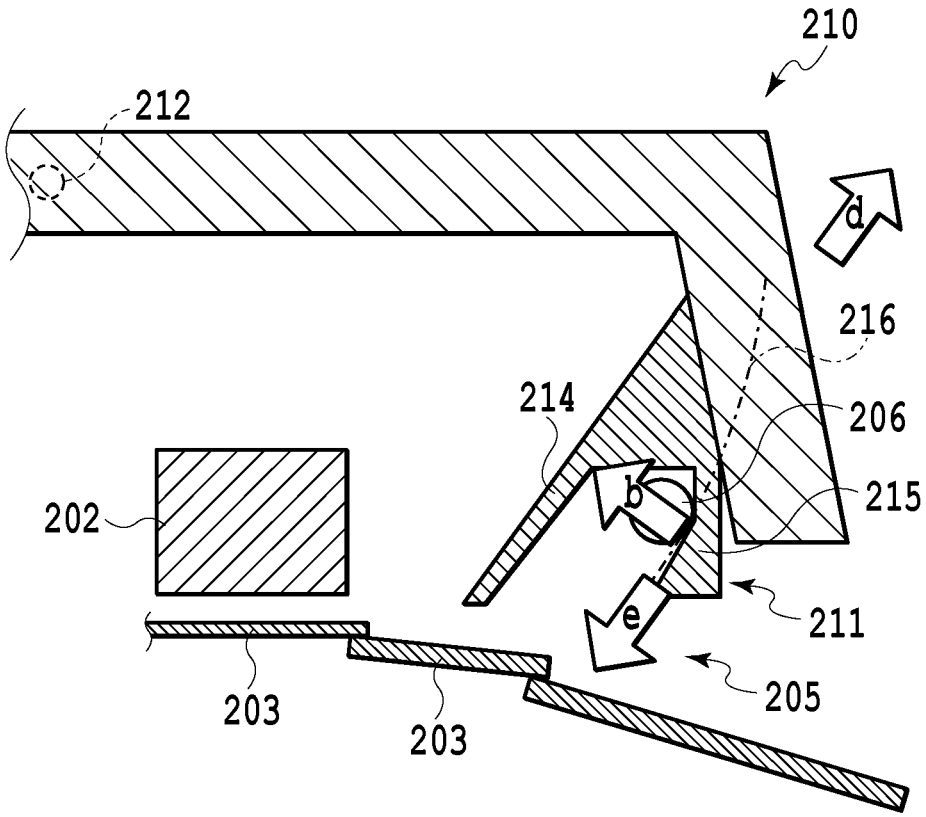
FIG. 13 is an illustration of the actions of forces in a case where a force acts in a direction of urging the access cover to be opened.

FIG. 13 is an illustration of the actions of forces in a case where a force acts on the access cover 210 in a direction of urging the access cover 210 to be opened while the forces act as shown in FIG. 12B. In a case where a force d acts on the access cover 210 to open it, the engaging portions 215 exert the force b described above on the projections 206. Friction e thus generated between the engaging portions 215 and the projections 206 resists against the movement of the access cover 210 in the opening direction. Further, the elastic deformation described above allows the engaging portions 215 to be partly located upstream of part of the circumcircle 216 that has its center at the turning shaft 212 of the access cover 210 and passes through the contacting portion 213. As a result, the movement of the engaging portions 215 in the direction of the force d is inhibited by the projections 206, thereby preventing the access cover 210 from being opened. This mechanism prevents the access cover 210 from being accidentally opened even though a user carelessly inserts the user's fingertip and lifts the user's hand.

As described above, a user cannot insert the user's fingertip into the apparatus beyond the protective wall portion and therefore never touches the moving carriage while the access cover is closed. Further, a force that acts in a case where a user touches the protective wall portion is used to generate a force that resists against the opening movement of the access cover. Accordingly, a user never opens the access cover accidentally to activate an interlock during printing operation. A user cannot open the access cover for maintenance if the user inserts the user's finger into the opening. In a case where the user opens the access cover during printing operation, the interlock is activated.

In both the first and second embodiments described above, a user inserts the user's finger into a discharging opening (opening) for discharging sheets in the case of touching the apparatus cover. However, the present invention is not limited to this. For example, in a case where an opening for inserting sheets is provided in a sheet feeding mechanism attached to a printing apparatus and a cover covers portions other than this opening, the cover side member described above may be used to prevent the cover from being opened even though a user inserts the user's finger into the opening. The present invention can also be applied to various processing apparatuses having processing units other than the printing unit such as scanners and machine tools.

According to the present invention, a user's finger can be more effectively prevented from entering a housing while a cover is closed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A printing apparatus comprising:

a printing unit configured to print on a sheet;

a housing configured to contain the printing unit;

a cover rotatably attached to the housing and configured to form an opening between the housing and the cover when the cover is closed, the sheet printed by the printing unit being discharged through the opening;

a conveying roller configured to convey the sheet in a conveying direction, from the printing unit to the opening;

a projection provided on the housing and positioned near the opening;

an engaging portion provided on the cover and configured to engage with the projection and to be positioned on a downstream side of the projection with respect to the conveying direction, when the cover is closed; and a protective wall portion provided inside the cover, wherein when the cover is closed, (a) an opening-side end of the protective wall portion is positioned on an upstream side of the projection with respect to the conveying direction and (b) in a case where the opening side end of the protective wall portion is pushed in a direction opposite to the conveying direction, the engaging portion is pushed to the projection, whereby a force that resists against an opening movement of the cover is generated between the engaging portion and the projection.

2. The printing apparatus according to claim 1, wherein the protective wall portion is equipped with a finger blocking portion that engages a user's fingertip.

3. The printing apparatus according to claim 1, wherein the protective wall portion has a sliding member slidable in a direction of narrowing the discharging opening, through which the sheet passes, by being pushed by a user's fingertip inserted through the discharging opening.

4. The printing apparatus according to claim 3, wherein the sliding member slides in a slanting backward direction by being pushed by the user's fingertip.

5. The printing apparatus according to claim 4, wherein the sliding member is biased by a biasing unit in a direction of expanding the discharging opening.

6. The printing apparatus according to claim 5, wherein the sliding member has a slit and engagement between the slit and a projection member provided in the protective wall portion allows the sliding member to slide and maintains the sliding member in a predetermined position.

7. The printing apparatus according to claim 3, wherein the sliding member is divided into several sliding members in a width direction of a sheet to be discharged and the sliding members are slidable independently of each other.

8. The printing apparatus according to claim 1, wherein the engaging portion is provided in plural at both ends of the protective wall portion, respectively, in a width direction of a sheet to be discharged, and the projection is provided in plural at two positions in the housing.

9. The printing apparatus according to claim 8, wherein, in a case in which the user's fingertip pushes the protective wall portion, the protective wall portion is elastically deformed and the positions of the engaging portions are changed.

10. The printing apparatus according to claim 1, further comprising a sensor configured to detect that the cover is opened, and a control unit configured to control the printing unit not to perform a printing operation based on a detection result by the sensor.

11. A processing apparatus comprising:

a processing unit configured to process a sheet;

a housing configured to contain the processing unit;

a cover rotatably attached to the housing and configured to form an opening between the housing and the cover when the cover is closed, the sheet processed by the processing unit being discharged through the opening;

a conveying roller configured to convey the sheet in a conveying direction, from the processing unit to the opening;

a projection provided on the housing and positioned near the opening;

an engaging portion provided on the cover and configured to engage with the projection and to be positioned on a downstream side of the projection with respect to the conveying direction, when the cover is closed; and a protective wall portion provided inside the cover, wherein when the cover is closed, (a) an opening-side end of the protective wall portion is positioned on an upstream side of the projection with respect to the conveying direction and (b) in a case where the opening side end of the protective wall portion is pushed in a direction opposite to the conveying direction, the engaging portion is pushed to the projection, whereby a force that resists against an opening movement of the cover is generated between the engaging portion and the projection.

12. The printing apparatus according to claim 1, wherein the engaging portion and the protective wall portion form an integrated cover side member, and the protective wall portion elastically deforms the cover so as to push the engaging portion against the projection.

13. The printing apparatus according to claim 12, wherein the cover side member has a U-shaped portion formed by the engaging portion and the protective wall portion, the projection entering into the U-shaped portion when the cover is closed.

14. The printing apparatus according to claim 1, wherein the protective wall portion extends over an entire area in a width direction of the sheet, and the engaging portion and the projection are provided in plural and positioned at each of both sides in the width direction of the sheet in the discharge opening.

15. The printing apparatus according to claim 1, further comprising a platen facing the printing unit.

16. The printing apparatus according to claim 1, wherein, in a case in which a force (d) acts on the cover in a direction of urging the cover to be opened while the cover is closed, and the opening-side end of the protective wall portion is pushed in a direction opposite to the conveying direction, friction (e) is generated between the engaging portion and the projection, the friction (e) resisting against movement of the cover in an opening direction.

17. The printing apparatus according to claim 1, wherein the engaging portion is formed integrally with the protective wall portion, and wherein in the case where the cover is closed, the projection is in a U-shaped space formed by the engaging portion and the protective wall portion.

18. The printing apparatus according to claim 1, further comprising a platen facing the printing unit, wherein a distance between the protective wall portion and the platen is smaller than a distance between the engaging portion and the platen in the case where the cover is closed.

19. The printing apparatus according to claim 1, further comprising a shaft about which the cover rotates, wherein a part of the engaging portion is a circumcircle which has its center at the shaft in the case where the cover is closed.

20. The processing apparatus according to claim 11, wherein, in a case in which a force (d) acts on the cover in a direction of urging the cover to be opened while the cover is closed, and the opening-side end of the protective wall portion is pushed in a direction opposite to the conveying direction, friction (e) is generated between the engaging portion and the projection, the friction (e) resisting against movement of the cover in an opening direction.

21. The processing apparatus according to claim 11, wherein the engaging portion is formed integrally with the protective wall portion, and wherein the projection is in a U-shaped space formed by the engaging portion and the protective wall portion in a case where the cover is closed.

22. The processing apparatus according to claim 11, further comprising a platen facing the printing unit, wherein a distance between the protective wall portion and the platen is smaller than a distance between the engaging portion and the platen in the case where the cover is closed.

23. The processing apparatus according to claim 11, further comprising a shaft about which the cover rotates, wherein a part of the engaging portion is a circumcircle which has its center about the shaft in the case where the cover is closed.

* * * * *